US010030862B2

(12) United States Patent
Burmeister

(10) Patent No.: US 10,030,862 B2
(45) Date of Patent: Jul. 24, 2018

(54) LAMP

(71) Applicant: Eaton Protection Systems IP GmbH & Co. KG, Schönefeld (DE)

(72) Inventor: Jens Burmeister, Eberbach (DE)

(73) Assignee: EATON PROTECTION SYSTEMS IP GMBH & CO. KG, Schonefeld (DE)

( * ) Notice: Subject to any disclaimer, the term of this patent is extended or adjusted under 35 U.S.C. 154(b) by 0 days.

(21) Appl. No.: 15/026,920

(22) PCT Filed: Oct. 8, 2013

(86) PCT No.: PCT/EP2013/003021
§ 371 (c)(1),
(2) Date: Apr. 1, 2016

(87) PCT Pub. No.: WO2015/051810
PCT Pub. Date: Apr. 16, 2015

(65) Prior Publication Data
US 2016/0258612 A1 Sep. 8, 2016

(51) Int. Cl.
*F21V 29/00* (2015.01)
*F21V 29/73* (2015.01)
(Continued)

(52) U.S. Cl.
CPC ..... *F21V 29/73* (2015.01); *F21V 25/12* (2013.01); *F21V 29/71* (2015.01); *F21V 29/717* (2015.01);
(Continued)

(58) Field of Classification Search
CPC ..... F21V 29/73; F21V 29/71; F21V 29/717; F21V 25/12; F21Y 2115/10; F21Y 2101/00
(Continued)

(56) References Cited

U.S. PATENT DOCUMENTS 6,632,405 B2 * 10/2003 Lua ..... B01F 3/022 422/123
8,915,603 B2 * 12/2014 Chan ..... F21V 29/405 165/67
(Continued)

FOREIGN PATENT DOCUMENTS

CN 102149962 9/2013
DE 102006001711 7/2007
(Continued)

OTHER PUBLICATIONS

Prevot, Eric, International Search Report issued in International Application No. PCT/EP2013/003021, completion date Jun. 23, 2014, dated Jun. 30, 2014.
(Continued)

*Primary Examiner* — Paultep Savusdiphol
(74) *Attorney, Agent, or Firm* — King & Spalding LLP

(57) ABSTRACT

A lamp, in particular for the use in potentially explosive areas, has at least one illuminant, one cooling device for the illuminant and one lamp enclosure with a light emission opening, whereby at least the illuminant and the cooling device are arranged in the lamp enclosure. To improve a heat transmission from the illuminant, in particular from the cooling device to the lamp enclosure, in a simple and safe way without the additional use of a heat-conducting paste or the like, whereby respective manufacturing tolerances that can negatively influence a good thermal contact shall no longer be considered, the cooling device for heat transmission to the lamp enclosure has a longitudinally variable cooling element or is formed as such.

13 Claims, 1 Drawing Sheet

(51) Int. Cl.

| | |
|---|---|
| ***F21V 25/12*** | (2006.01) |
| ***F21V 29/71*** | (2015.01) |
| *F21V 19/02* | (2006.01) |
| *F21Y 115/10* | (2016.01) |
| *F21Y 101/00* | (2016.01) |

(52) U.S. Cl.
CPC ..... *F21V 19/02* (2013.01); *F21Y 2101/00* (2013.01); *F21Y 2115/10* (2016.08)

(58) Field of Classification Search
USPC ..... 362/234, 294
See application file for complete search history.

(56) References Cited

U.S. PATENT DOCUMENTS

| | | | | |
|---|---|---|---|---|
| 2011/0261572 | A1* | 10/2011 | Watanabe | F21V 19/001 362/373 |
| 2012/0002429 | A1* | 1/2012 | Watanabe | F21V 19/001 362/382 |
| 2014/0153219 | A1* | 6/2014 | Chan | F21V 29/405 362/92 |

FOREIGN PATENT DOCUMENTS

| | | |
|---|---|---|
| DE | 102008060444 | 11/2009 |
| DE | 102010060642 | 5/2012 |
| EP | 2336631 | 6/2011 |
| EP | 2366937 | 9/2011 |
| WO | 2004055433 | 7/2004 |

OTHER PUBLICATIONS

Machine Translation of WO 2004055433, via LexsisNexsis Total Patents, 8 pages.
Machine Translation of DE 102006001711, via LexsisNexsis Total Patents, 6 pages.
Machine Translation of DE 102008060444, via LexsisNexsis Total Patents, 9 pages.
Machine Translation of DE 102010060642, via LexsisNexsis Total Patents, 10 pages.
CN Office Action issued in Chinese application No. 201380080131.9, dated Feb. 13, 2017, 9 pages, The State Intellectual Property of The People's Republic of China.
Machine Translation of CN102149962, via LexsisNexsis Total Patents, Jun. 8, 2017, 25 pages.
Machine Translation of Chinese Office Action 9 pages.

* cited by examiner

LAMP

PRIORITY CLAIM

The present application is a national phase application of and claims priority to International Application No. PCT/EP2013/003021 with an International filing date of Oct. 8, 2013. The foregoing application is hereby incorporated herein by reference.

TECHNICAL FIELD

The invention relates to a lamp, in particular for the use in potentially explosive areas, with at least one illuminant, a cooling device for the illuminant and a lamp enclosure with a light emission opening, whereby the illuminant and the cooling device are arranged in the lamp enclosure.

BACKGROUND

In such lamps, the illuminant is a source of heat that has to be cooled down by means of the respective cooling device, which is advantageous or even necessary in particular with regard to the use in potentially explosive areas. The illuminant is usually disposed in close proximity to the cooling device or on the cooling device. A cooling body with appropriate cooling fins can for example be used as a cooling device.

In recent times, for example LEDs (light-emitting diodes) have been frequently used as illuminants. In contrast to the illuminants that have been commonly used up to present, they are more effective with regard to a respective transformation of the energy used into visible light. However, also in these LEDs, only a maximum of 30% of the energy used is transformed into visible light. Especially in case of such illuminants, it is though necessary for them to be cooled sufficiently as their lifespan, light yield or also their color emission would otherwise be negatively influenced in case of too high temperatures. In addition, the rule that in case of temperatures of 120° C. or more, a respective semiconductor crystal of the LED will be damaged, which will lead to permanent impairment of lifespan, light color, light yield or the like, applies.

The cooling systems used up to present are fastened within the lamp enclosure in a way that on one hand a respective heat transmission from the illuminant to the cooling device can take place and on the other hand the alignment of the illuminant in relation to the appropriate light emission opening is ensured. However, appropriate reflection devices can be used as aids for this purpose.

Experience has shown that both the cooling device as well as the respective points of the lamp enclosure on which the cooling device is fastened have manufacturing tolerances so that a relevant heat transmission contact between the cooling device and the lamp enclosure for dissipation of the heat to the enclosure and finally into the environment is impaired. This is partially compensated through additional application of a heat-conducting paste or the like.

SUMMARY

Hence, the invention is based on the purpose of improving heat transmission from the illuminant and in particular from the cooling device to the lamp enclosure in a simple and safe way without the additional use of a heat-conducting paste or the like, whereby respective manufacturing tolerances that can negatively influence a good thermal contact shall no longer be considered.

This problem is solved by the features of Patent claim 1. In particular, the invention is characterized in that the cooling device for a sufficient contact with the lamp enclosure for heat transmission has a cooling element with a variable length or is formed as such.

The cooling element with a variable length extends between the remaining cooling device and the lamp enclosure and therefore creates a sufficient contact for heat transmission also in case of manufacturing tolerances. This means that on one hand there is a contact between the cooling device and the lamp enclosure, which, however, is possibly influenced negatively by the manufacturing tolerances, so that an additional contact, which compensates any heat transmission loss due to the manufacturing tolerances or the like, is created through the cooling element with a variable length.

There is also the possibility of the cooling device being formed directly as such a cooling element with a variable length so that its dimensions can be increased or reduced in order to improve the contact with the respective fastening point in the lamp enclosure or to create further contacts to the lamp enclosure.

Depending on requirement and arrangement of the cooling device in the lamp enclosure, the contact is improved or an additional contact for heat transmission to the lamp enclosure is created through this length variability.

This means that the direct contact between the heat source, i.e. the illuminant, and the lamp enclosure is improved and usually increased also in case of manufacturing tolerances by means of the cooling element with a variable length.

If the cooling device comprises for example a cooling body, the cooling element with a variable length can extend between this cooling body and a suitable enclosure part, in particular an enclosure wall. The length of the cooling element is adapted to the distance of the cooling body from the enclosure part.

A simple embodiment for such a cooling element with a variable length is for example a cooling spring. This cooling spring is simply arranged between the cooling body and the enclosure part and kept in its position by means of its own spring tension. The cooling spring is formed of an appropriate material with a high thermal conductivity such as a metal or appropriate alloys.

In a further embodiment, the cooling element with a variable length can be formed as a telescopically extendable cooling element. This means that for example two or more pipes, which are plugged into each other and that can be slid apart in relation to each other, extend between the cooling body and the respective enclosure part.

In this context, it is of course also possible that appropriate cooling elements with a variable length are arranged on different sides of the cooling body between the latter and a respective enclosure part. If the cooling body is for example cuboid-shaped, respective cooling elements with a variable length can extend from the cooling body to the adjacent enclosure part from all side surfaces of the cooling body and improve the heat transmission to the lamp enclosure considerably.

The cooling elements with a variable length can be arranged in a simple way and usually also formed in a retrofittable way. This means that, depending on the requirements, such a cooling element with a variable length can be installed or further cooling elements with a variable length can be added to the existing ones.

In a further embodiment according to the invention, the cooling body is directly variable in length, i.e. one of its body surfaces can be supported on a respective device within the lamp enclosure and be led towards other body surfaces, in particular the enclosure wall, due to its variable length so that a heat transmission to the lamp enclosure can take place there as well.

A simple embodiment of such a cooling body with a variable length can for example be seen in that said cooling body has two meshing cooling body parts that can be displaced in relation to each other and while a heat transmission between them is maintained. Such a relocatability can arise for example due to arm-like edges that extend from one cooling body part and that mesh relocatably with respective openings in the other cooling body part. Therefore, the cooling body parts can be moved in relation to each other but remain in heat transmission contact in case of an appropriate variation of its extension and/or length in the respective direction.

Other possibilities for meshing of the cooling body parts and to enable a relative displacement of the cooling body parts are conceivable.

To be able to press the respective cooling body parts onto the enclosure walls as enclosure parts in a simple way, the cooling body parts can be spring-loaded in the direction of separation of these parts. This means that the cooling body parts are brought into appropriate positions in a compressed form and the external pressure is removed after arrangement in the installation position so that the cooling body parts can be moved away from each other in the direction of separation and brought in contact with the enclosure parts through the spring load.

To prevent the cooling body parts from being separated from each other completely through the spring load, it can turn out to be advantageous if the cooling body parts have a retention unit to limit the length variability in the direction of separation. Such a retention unit can be a latching mechanism, a physical end stop or the like.

To improve a respective heat transmission contact between the cooling element with a variable length and the respective enclosure parts, the cooling element with a variable length can have cooling surfaces on its respective ends to attach themselves to the enclosure part and/or on the cooling body. These cooling surfaces can have larger dimensions than the respective ends of the cooling elements. For example in case of the cooling spring, it can have flat cooling plates as cooling bodies on its ends, which can in particular be pressed onto the enclosure wall and respectively also onto the cooling body. Therefore, the surface contact between said elements is increased so that a higher heat transmission can take place. Appropriate cooling surfaces can also be disposed on the ends of the telescopically extendable cooling element. It would further be advantageous in this context if the cooling surfaces had a certain flexibility, for example to be able to adapt easily to respective curvatures of the enclosure parts and/or of the cooling body.

To improve a respective heat transmission, in particular in case of parts of the cooling device that can be displaced in relation to each other, or to intensify the contact between these parts that can be moved in relation to each other for a heat transmission, a heat transmission medium can be arranged between the cooling body parts that can be displaced in relation to each other or the parts of the telescopically extendable cooling element that can be displaced in relation to each other. It is also possible that, in addition, such a heat transmission medium will be arranged between the respective cooling surfaces and enclosure parts and/or cooling bodies.

To be able to adapt a respective cooling element with a variable length in a simple way to different installation situations and different lamp enclosures, it can turn out to be advantageous if at least the cooling surfaces are replaceable. This means that for example a cooling surface with a specific geometry and curvature is replaced by another cooling surface that is attached better to the respective enclosure part and/or cooling body for heat transmission.

Due to the invention, there is the simple possibility to arrange the respective illuminant directly on top of the cooling body or on the cooling body. Of course, this shall also apply if not only one illuminant but multiple or a plurality of such illuminants are arranged on the cooling body and/or on top of the cooling body. An example for such an illuminant is an individual LED or multiple LEDs that are available for example in form of LED light strips, LED spots, LED stripes or the like.

BRIEF DESCRIPTION OF THE DRAWINGS

In the following, advantageous embodiments of the invention will be explained in greater detail by means of the Figures included in the drawing.

The Figures show.

DETAILED DESCRIPTION OF THE EXAMPLE EMBODIMENTS

Figure 1:
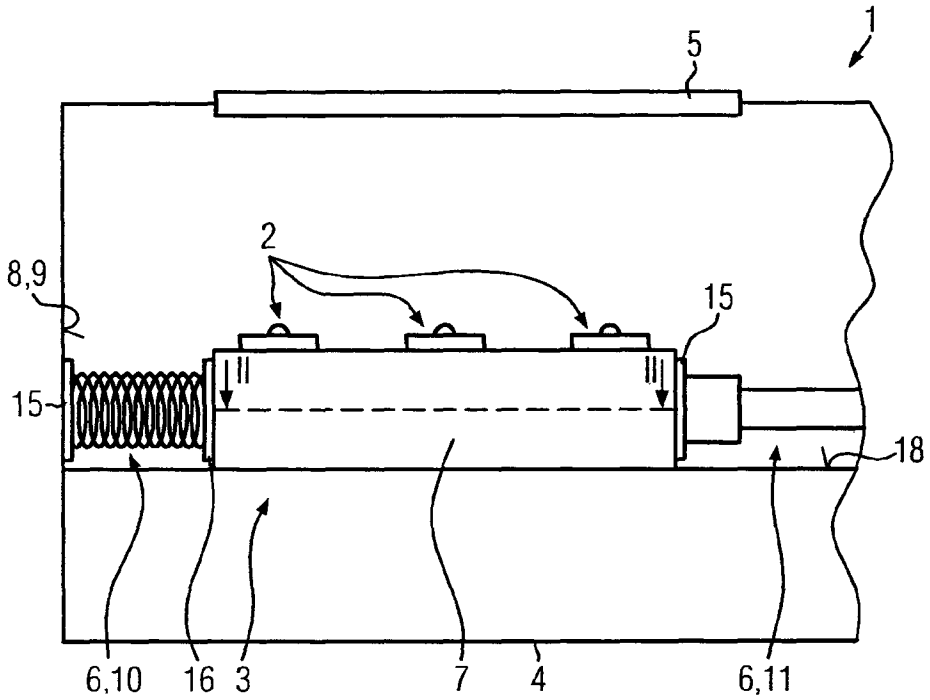
FIG. 1 a schematic display of a lamp with a cooling device according to the invention and FIG. 2 a section along the line II-II from FIG. 1 for a further embodiment of the invention.

FIG. 1 shows a side view in form of a cross-section through a lamp 1 according to the invention. This lamp comprises a lamp enclosure 4 in which at least a number of illuminants 2 and an associated cooling device 3 are arranged. Further electric or electronic devices and also reflection devices are not displayed in FIG. 1 for reasons of simplification.

The cooling device 3 comprises for example a cooling body 7 in form of a cuboid or the like on which, however, also cooling fins can be arranged. Three illuminants 2 in form of LEDs (light-emitting diodes) are displayed on a light emission opening 5 of the top side of the cooling body 7 that faces the lamp enclosure 4. It is clear that also more of such LEDs 2 can be arranged. In addition, there has to be no appropriate space between the illuminants but they can for example be arranged in form of a LED light band or stripe directly on top of the cooling body.

According to the invention, an additional cooling element in form of a cooling element 6 with a variable length is arranged besides the cooling body 7 as part of the cooling device 3. For example, such a cooling element 6 with a variable length is arranged in the form of a cooling spring 10 in a one-sided position in relation to the cooling body 7. This cooling spring extends between one end side of the cooling body 7 and an enclosure part 8 in form of an enclosure wall 9. The cooling spring 10 presses with both of its ends on one side against the enclosure wall and on the other side against the cooling body 7. To increase the contact surface, the cooling spring can have cooling surfaces 15 and/or 16 on its ends. These cooling surfaces are connected to the cooling spring 10 and fit flatly with the enclosure wall 9 and/or the cooling body 7.

The cooling surfaces 15, 16 can be formed in a replaceable and/or flexible way. Due to the flexibility, a better adaptation to possibly curved surfaces of the enclosure wall 9 and/or of the cooling body 7 takes place. Also, there is the possibility that respective cooling surfaces 15, 16 have structures that are complementary to structures of the enclosure wall 9 and/or of the cooling body 7.

A further embodiment of a cooling element 6 with a variable length in form of a telescopically extendable cooling element 11 is arranged on the other side of the cooling body 7. It comprises for example two pipe elements that are plugged into each other and that can be slid apart from and into each other in a longitudinally variable way. The displayed form of the telescopically extendable cooling element 11 is only an exemplary one, whereby pipe-shaped, rail-shaped or other telescopically extendable elements can be used. Also in this telescopically extendable cooling element 11 it will be advantageous if the respective telescope elements are spring-loaded in the extension direction.

The cooling body 7 lies on an support surface 18 and maintains a heat transmission contact with this surface. Through the telescopically extendable cooling elements 6, a further heat transmission contact to the respective points of the lamp enclosure 4 and in particular to the enclosure wall 9 as a respective enclosure part 8 is created.

Figure 2:
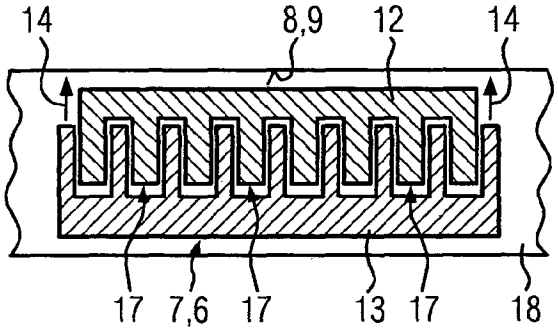

FIG. 2 shows a section along the line II-II from FIG. 1 for a further embodiment of the invention. In this embodiment, the cooling body 7 is formed directly as a cooling element 6 with a variable length. This means that the cooling body 7 consists of at least two cooling body parts 12 and/or 13 that can be slid into and out of each other in relation to each other. The respective cooling body 7 is arranged on the support surface 18, but can also create a further contact to an enclosure wall 9 as an enclosure part 8 through extension of the cooling body part 12 and/or 13. In FIG. 2, the two cooling body parts 12, 13 are still shown as compressed and not making use of their length variability and in addition in contact with the enclosure wall 9. Spring elements 17 that support the extension of the cooling body parts 12, 13 in the direction of separation 14 can be arranged between the two cooling body parts 12, 13. This means that if an extension of the cooling body part 12 out of cooling body part 13 is allowed, it will move through the spring elements 17 up to fitting closely with the enclosure wall 9 due to the spring load. Therefore, a further thermal contact to the lamp enclosure 4 is created, which at least compensates—where required—an impairment of a thermal contact between the cooling body 7 and the enclosure surface 18 due to manufacturing tolerances or the like.

Other ways of interaction of the cooling body parts 12 and 13 are conceivable. In the displayed embodiment, both cooling body parts 12, 13 mesh in a comb-like way.

A retention mechanism, which prevents for example a too wide separation of the cooling body part 12 from the cooling body part 13 in the direction of separation 14 so that a specific meshing process of the two cooling body parts 12 and 13 is always ensured, is not shown in FIG. 2. Such a retention mechanism can for example be a latching mechanism, a mechanical end stop or the like.

Between the parts that can be moved in relation to each other, for example of the telescopically extendable cooling element 11 and/or cooling body parts 12 and 13, a respective heat-conducting medium can be applied for better coupling and heat transmission.

According to the invention, a simple possibility arises to compensate respective manufacturing tolerances during manufacturing of the lamp and the cooling device that might have a negative influence on a heat transmission between these parts. For this purpose, the cooling device has a cooling element with a variable length that usually creates a further contact between a cooling element of the cooling device and a respective enclosure part of the lamp enclosure. Therefore, the overall heat transmission from the heat source, i.e. the illuminant(s) to the lamp enclosure, is improved, whereby the latter can emit heat to the environment accordingly.

Through the use of the cooling element with a variable length, no additional active cooling of the illuminants, for example in form of a ventilator or the like, is required anymore for many embodiments of a lamp.

The invention claimed is:

1. A lamp, in particular for use in potentially explosive areas, with at least one illuminant, a cooling device for the illuminant and a lamp enclosure with a light emission opening; the lamp enclosure in which at least the illuminant and the cooling device are arranged, characterized in that the cooling device for heat transmission to the lamp enclosure has a cooling element having a length that is longitudinally variable independent of an arrangement of the at least one illuminant, and characterized in that the cooling element extends between a cooling body of the cooling device on which the at least one illuminant is disposed and an enclosure part.

2. The lamp according to claim 1, characterized in that the cooling element is formed as a cooling spring.

3. The lamp according to claim 1, characterized in that the cooling element is formed as a telescopically extendable cooling element.

4. The lamp according to claim 1, characterized in that the cooling element comprises a plurality of cooling elements arranged on different sides of the cooling body between said cooling body and the enclosure part.

5. The lamp according to claim 1, characterized in that the cooling element is retrofittable.

6. The lamp according to claim 1, characterized in that the cooling body is longitudinally variable.

7. The lamp according to claim 1, characterized in that the cooling body has two meshing cooling body parts that can be displaced in relation to each other while a heat transmission contact is maintained.

8. The lamp according to claim 7, characterized in that the two meshing cooling body parts are spring-loaded in a direction of separation of the cooling body parts.

9. The lamp according to claim 7, characterized in that the two meshing cooling body parts have a retention device to limit a length variation in a direction of separation to ensure a meshing between the meshing cooling parts.

10. The lamp according to claim 1, characterized in that the cooling element has cooling surfaces on its ends to fit closely with the associated enclosure part and/or with the cooling body.

11. The lamp according to claim 10, characterized in that a heat transmission medium is arranged between the cooling surfaces and/or the cooling element and the enclosure part and/or cooling body.

12. The lamp according to claim 10, characterized in that the cooling surfaces are replaceable.

13. The lamp according to claim 1, characterized in that the illuminant has a single LED or a plurality of LEDs.

* * * * *